US008043125B2

(12) United States Patent
Doorhy et al.

(10) Patent No.: US 8,043,125 B2
(45) **Date of Patent: *Oct. 25, 2011**

(54) WIRE CONTAINMENT CAP

(75) Inventors: Michael V. Doorhy, Mokena, IL (US); Masud Bolouri-Saransar, Orland Park, IL (US); Satish I. Patel, Roselle, IL (US); David A. Dylkiewicz, Lockport, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/794,375

(22) Filed: Jun. 4, 2010

(65) Prior Publication Data

US 2010/0267272 A1 Oct. 21, 2010

Related U.S. Application Data

(63) Continuation of application No. 12/272,286, filed on Nov. 17, 2008, now Pat. No. 7,731,542, which is a continuation of application No. 11/195,412, filed on Aug. 2, 2005, now Pat. No. 7,452,245.

(60) Provisional application No. 60/598,640, filed on Aug. 4, 2004, provisional application No. 60/637,247, filed on Dec. 17, 2004.

(51) Int. Cl.
*H01R 24/00* (2006.01)

(52) U.S. Cl. ..... 439/676; 439/460; 439/456

(58) Field of Classification Search ..... 439/404, 439/395, 676, 941, 417, 456, 460
See application file for complete search history.

(56) References Cited

U.S. PATENT DOCUMENTS

| | | | | |
|---|---|---|---|---|
| 4,059,331 | A * | 11/1977 | Sedlacek et al. | 439/719 |
| 4,178,055 | A * | 12/1979 | Fleischhacker et al. | 439/402 |
| 4,537,455 | A * | 8/1985 | Vertenten et al. | 439/404 |
| 4,836,803 | A * | 6/1989 | Seidel | 439/447 |
| 5,885,111 | A * | 3/1999 | Yu | 439/676 |
| 6,056,586 | A * | 5/2000 | Lin | 439/460 |
| 6,267,617 | B1 * | 7/2001 | Nozick | 439/417 |
| 6,338,655 | B1 * | 1/2002 | Masse et al. | 439/638 |
| 6,488,525 | B2 * | 12/2002 | Abel et al. | 439/404 |
| 6,767,241 | B1 * | 7/2004 | Abel et al. | 439/417 |
| 7,384,298 | B2 * | 6/2008 | Caveney et al. | 439/404 |
| 7,452,245 | B2 * | 11/2008 | Doorhy et al. | 439/676 |

* cited by examiner

*Primary Examiner* — Felix O Figueroa
(74) *Attorney, Agent, or Firm* — Robert A. McCann; Zachary J. Smolinski; Christopher K. Marlow

(57) ABSTRACT

A wire containment cap includes a first side having a plurality of retainers for retaining wires, and a second side opposite the first side. Two sidewalls extend between the first side and the second side, and a support rib extends between the two sidewalls. The support rib includes two pair separators for separating wire pairs. In one embodiment, a plurality of sloped pair splitters is located between two of the retainers and includes a sharp point for cutting through insulation material on a pair of bonded wires. A communication jack assembly including a front portion and the wire containment cap is also described.

10 Claims, 10 Drawing Sheets

WIRE CONTAINMENT CAP

CROSS-REFERENCE TO RELATED APPLICATIONS

This application is a continuation of U.S. patent application Ser. No. 12/272,286, filed Nov. 17, 2008, which issued as U.S. Pat. No. 7,731,542 on Jun. 8, 2010, which is a continuation of U.S. patent application Ser. No. 11/195,412, filed Aug. 2, 2005, which issued as U.S. Pat. No. 7,452,245 on Nov. 18, 2008, and claims the benefit of U.S. Provisional Application No. 60/598,640, filed Aug. 4, 2004 and U.S. Provisional Application No. 60/637,247, filed Dec. 17, 2004, which are incorporated herein by reference in their entireties.

FIELD OF THE INVENTION

The present invention relates generally to electrical connectors, and more particularly, to a modular communication jack design with an improved wire containment cap.

BACKGROUND OF THE INVENTION

In the communications industry, as data transmission rates have steadily increased, crosstalk due to capacitive and inductive couplings among the closely spaced parallel conductors within the jack and/or plug has become increasingly problematic. Modular connectors with improved crosstalk performance have been designed to meet the increasingly demanding standards. Many of these connectors have addressed crosstalk by compensating at the front end of the jack, i.e., the end closest to where a plug is inserted into the jack. However, the wire pairs terminated to the insulation displacement contact ("IDC") terminals at the rear portion of a jack may also affect the performance of the jack.

One problem that exists when terminating wire pairs to the IDC terminals of a jack is the effect that termination has on the crosstalk performance of a jack. When a twisted pair cable with four wire pairs is aligned and terminated to the IDC terminals of a jack, a wire pair may need to flip over or under another wire pair. An individual conductor of a wire pair may also be untwisted and oriented closely to a conductor from a different wire pair. Both of these conditions may result in unintended coupling in the termination area which can degrade the crosstalk performance of the jack. Thus, a solution addressing the crosstalk in the termination area of the jack would be desirable. This solution should produce a termination that is as noiseless as possible to minimize the crosstalk of that termination.

A second problem that exists when terminating wire pairs to the IDC terminals of a jack is variability. A technician is typically called on to properly terminate the wire pairs of a twisted pair cable to the proper IDC terminals of the jack. Each jack terminated by the technician should have similar crosstalk performance. This requires the termination to remain consistent from jack to jack. However, different installers may use slightly different techniques to separate out the wire pairs and route them to their proper IDC terminals. Thus, a solution that controls the variability of terminations from jack to jack would be desirable.

A final issue that arises when terminating wire pairs to the IDC terminals of a jack is the difficulty of the termination process. Typical jacks provide little assistance to the technician, resulting in occasional misterminations (e.g. a wire being terminated at an incorrect location in the jack). Even if detailed instructions are provided with the jack, technicians may not read these instructions prior to installing the jacks.

Furthermore, a jack with a difficult termination process can increase the installation time for the technician and result in a costly installation for the customer. Thus, a jack solution that simplifies the termination process and minimizes the possibility of technician error would be desirable.

SUMMARY

The present application meets the shortcomings of the prior art by providing a wire containment cap having a first side including a plurality of retainers for retaining wires, a second side being opposite the first side, two sidewalls extending between the first side and the second side, a support rib extending between the two sidewalls and including two pair separators for separating a pair of wires, and a plurality of sloped pair separators located between two of the retainers and including a sharp point for cutting through insulation material on a pair of bonded wires.

A communication jack assembly is also described. The communication jack comprises a front portion including a retention clip, and a wire containment cap including a retention recess for securing the wire containment cap to the front portion. The wire containment cap comprises a first side including a plurality of retainers for retaining wires, a second side being opposite the first side, two sidewalls extending between the first side and the second side, a support rib extending between the two sidewalls and including two pair separators for separating a pair of wires, and a plurality of sloped pair separators located between two of the retainers and including a sharp point for cutting through insulation material on a pair of bonded wires.

DETAILED DESCRIPTION OF THE PREFERRED EMBODIMENTS

Figure 1:
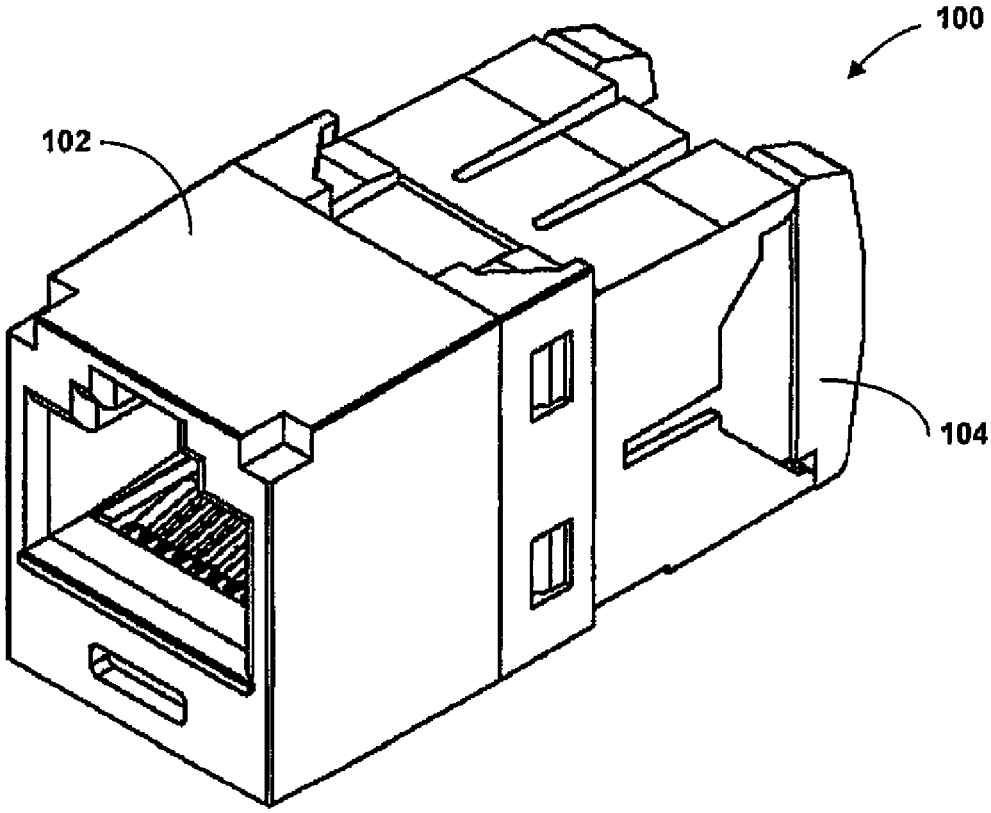
FIG. 1 is a front upper right perspective view of a communication jack having a wire containment cap in accordance with an embodiment of the present invention.

FIG. 1 is a front upper right perspective view of a communication jack 100 in accordance with an embodiment of the present invention. The communication jack 100 includes a front portion 102 and a wire containment cap 104. The front portion 102 may include such components as plug interface contacts, a mechanism for coupling the jack to a plug, crosstalk compensation circuitry, and wire-displacement contacts to provide an electrical connection between the jack and a communication cable. Additional details on the wire containment cap 104 are described with reference to FIGS. 3-7, below.

Figure 2:
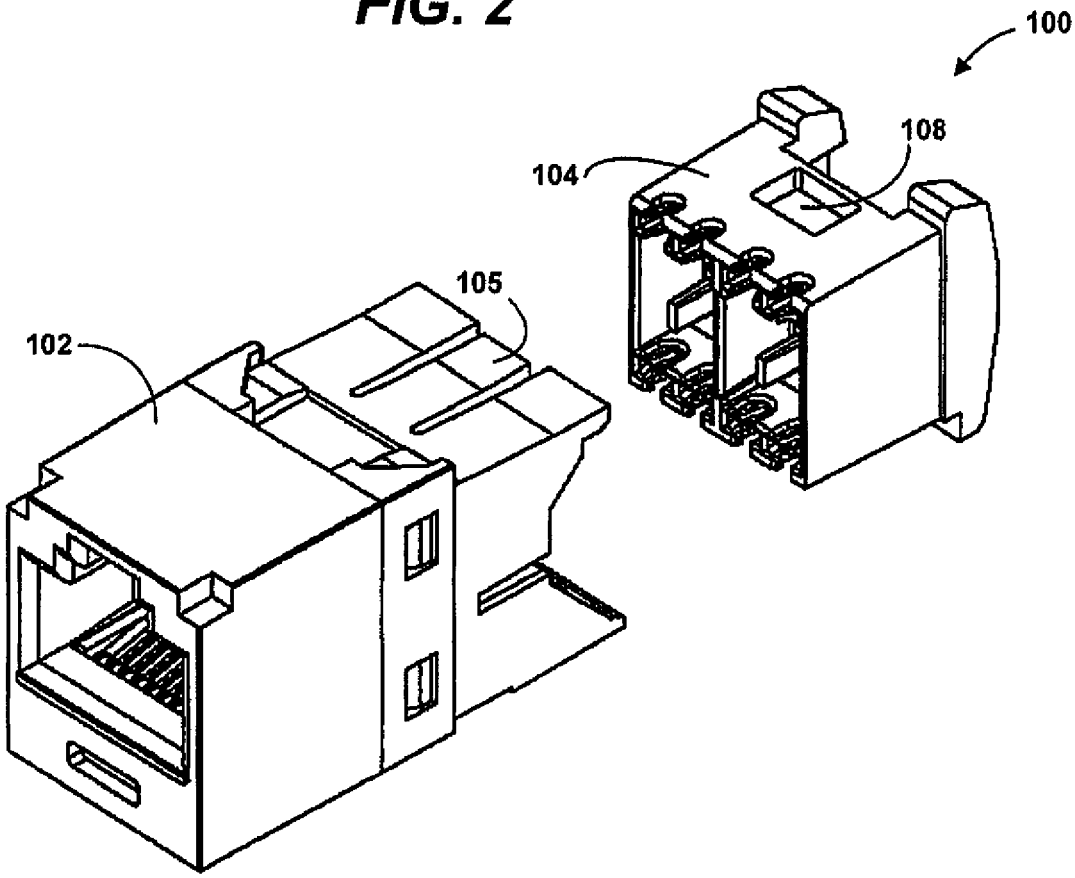
FIG. 2 is a front upper right partial-exploded view of the communication jack of FIG. 1.
Figure 3:
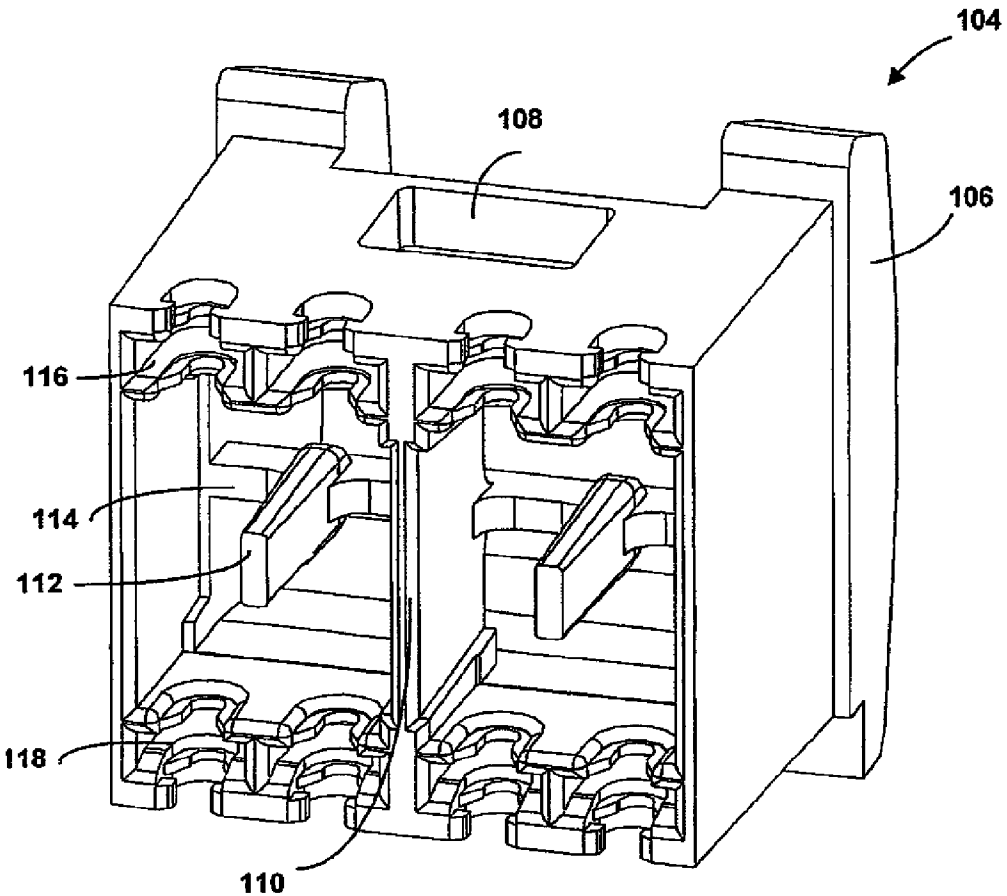
FIG. 3 is a front upper right perspective view of a wire containment cap in accordance with an embodiment of the present invention.
Figure 4:
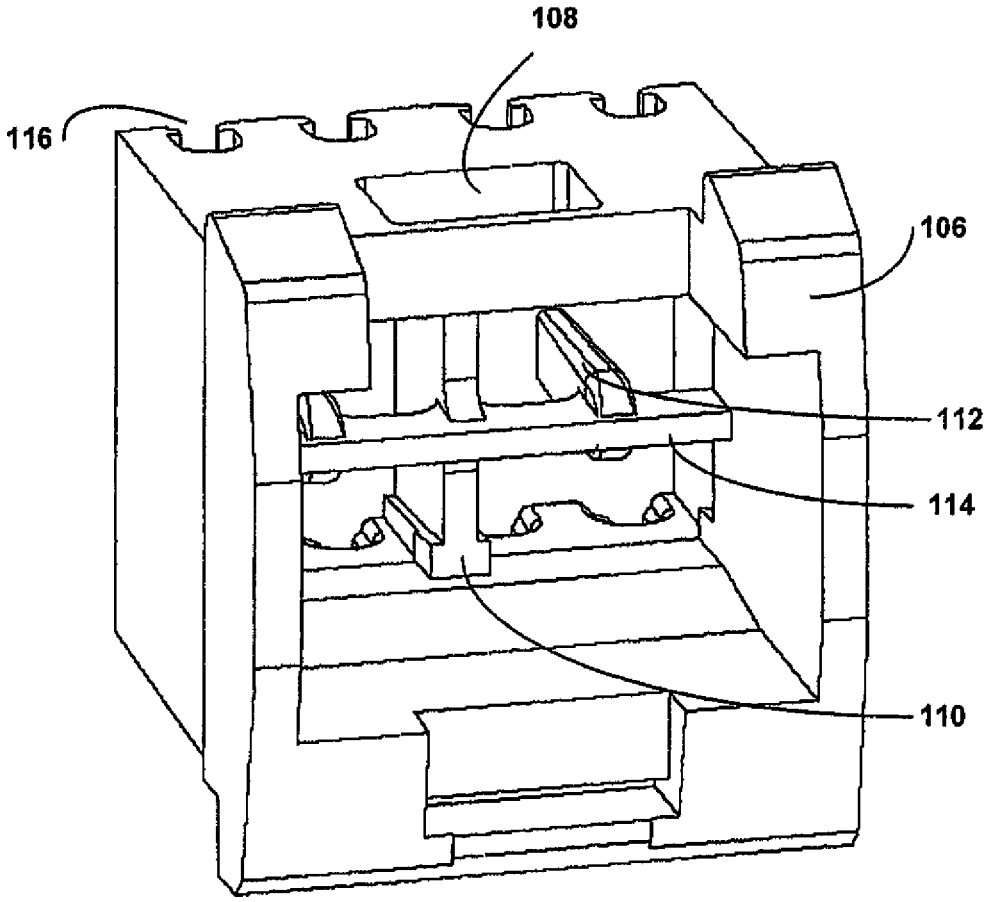
FIG. 4 is a rear upper left perspective view of a wire containment cap in accordance with an embodiment of the present invention.
Figure 5:
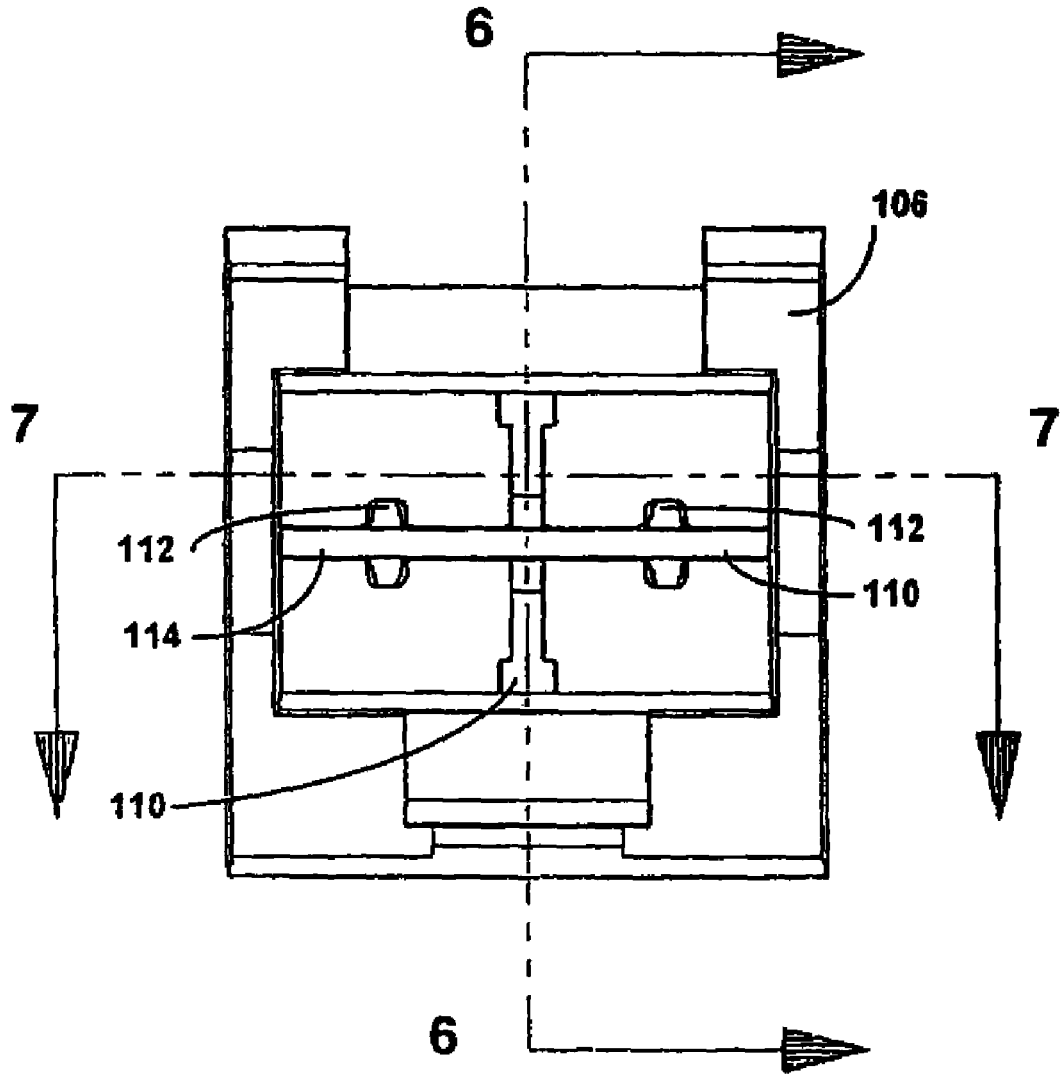
FIG. 5 is a rear isometric view of a wire containment cap in accordance with an embodiment of the present invention, showing cross-sections 6-6 and 7-7.
Figure 6:
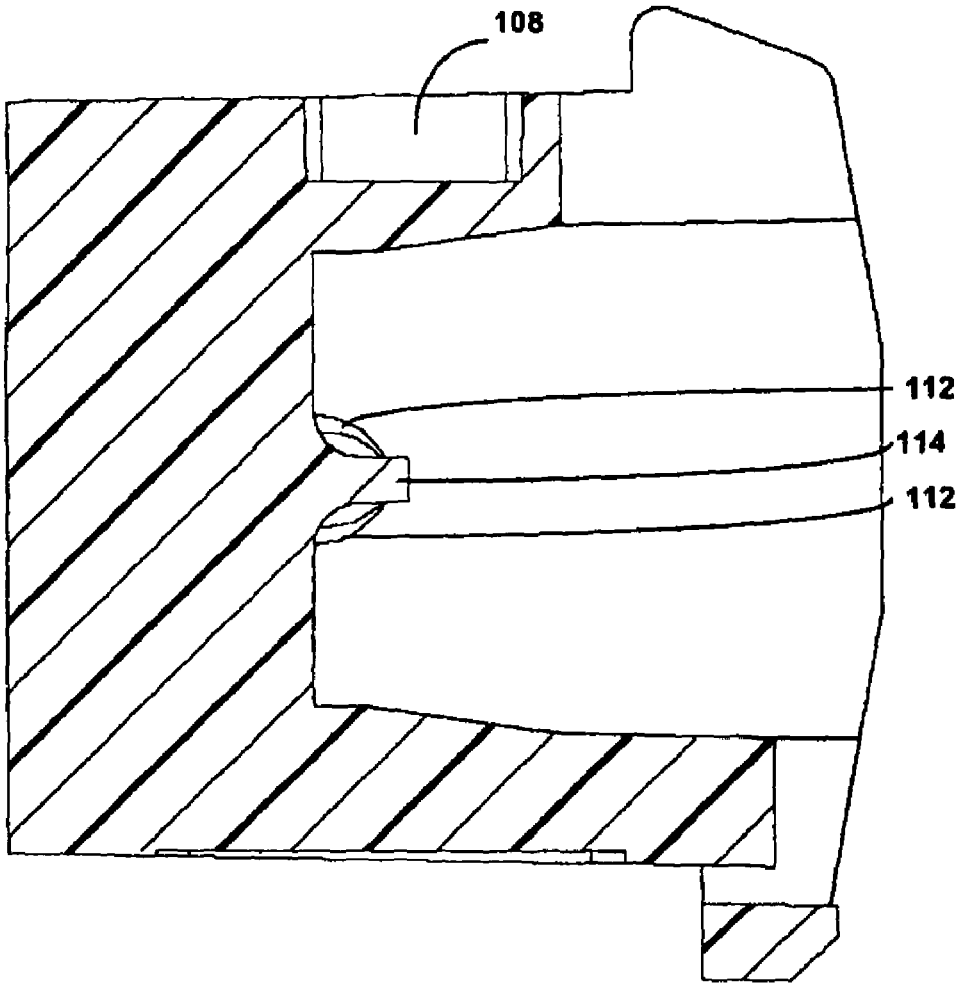
FIG. 6 is a cross-sectional view of a wire containment cap taken across cross section 6-6 from FIG. 5, in accordance with an embodiment of the present invention.
Figure 7:
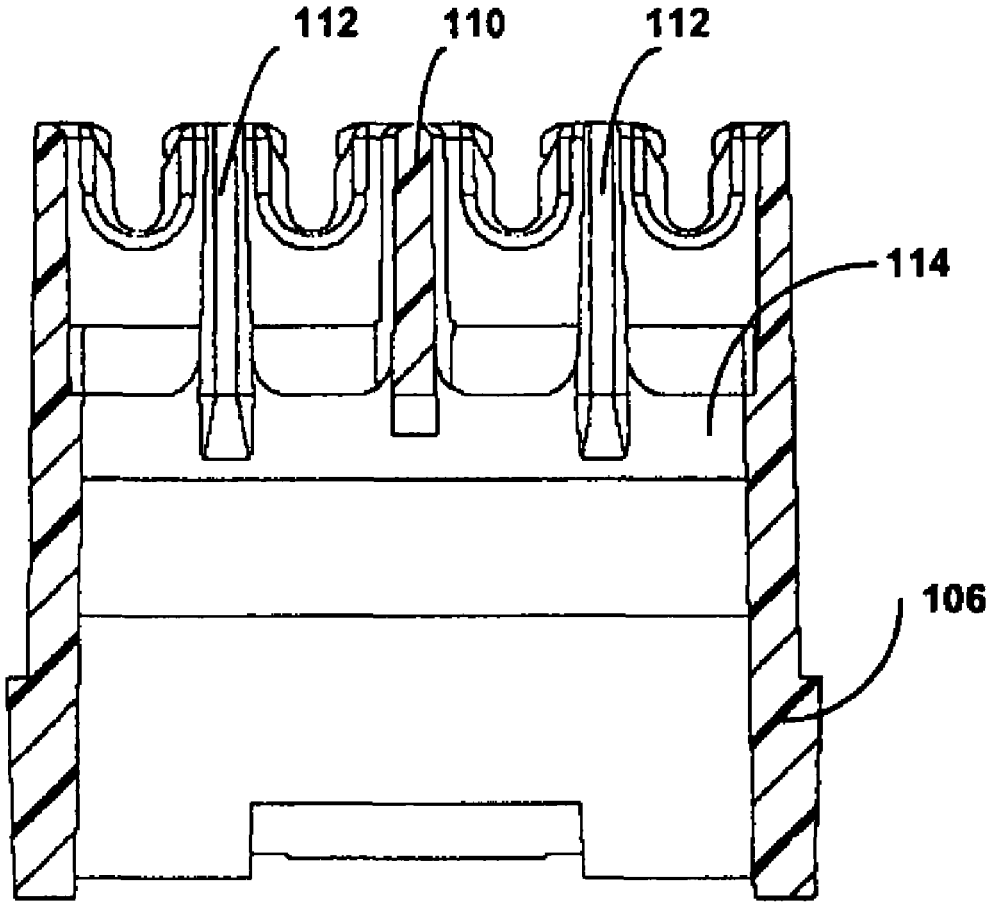
FIG. 7 is a cross-sectional view of a wire containment cap taken across cross section 7-7 from FIG. 5, in accordance with an embodiment of the present invention.

FIG. 2 is a front upper right partial-exploded view of the communication jack 100 of FIG. 1. In the embodiment shown, the wire containment cap 104 is slidably mounted within the front portion 102. A retention clip 105 on the front portion 102 and a retention recess 108 on the wire containment cap 104 may be included to secure the wire containment cap 104 to the front portion 102. Other mounting and securing techniques may also be used.

FIGS. 3-7 illustrate the wire containment cap 104 in further detail, in accordance with an embodiment of the present invention. The wire containment cap 104 includes a large opening in the back to allow a cable to be inserted, and allow the pairs to separate quickly as they transition toward IDC terminals. The opening consists of four individual quadrants with a spine 110 between pairs to minimize cable interaction. In addition to the retention recess 108 described above with reference to FIG. 2, the wire containment cap 104 includes a shoulder 106, a spine 110, two pair separators 112, a support rib 114 to support each pair separator 112, upper wire retainers 116, and lower wire retainers 118. FIGS. 3-7 illustrate additional details as well, such as a possible frame shape for the wire containment cap 104. In a preferred embodiment, the wire containment cap 104 is constructed of a plastic material, such as polycarbonate. Alternative materials, shapes, and subcomponents could be utilized instead of what is illustrated in FIGS. 3-7.

The shoulder 106 serves as a support and stopping mechanism to place the wire containment cap 104 in a correct physical position with respect to the front portion 102 shown in FIGS. 1 and 2. Alternative support and/or stopping mechanisms could also be used, such as one located on the front portion 102, or on the wire containment cap 104 in such a position that it abuts an interior location in the front portion 102, rather than the exterior abutment shown in FIGS. 1 and 2.

The pair separators 112 are supported by the spine 110 and support rib 114, and are positioned generally perpendicular to the support rib 114. The pair separators 112 are advantageous because when the wire pairs are aligned with the IDC terminals, at least one wire pair will typically have to flip over or under the other pairs on at least one end of a twisted pair cable. One reason this flip may occur is because the wire pair layout on one end of a twisted pair cable is a mirror image of the wire pair layout on the opposite end of the twisted pair cable. Another reason this flip may occur is because the Telecommunications Industry Association ("TIA") standards allow structured cabling systems to be wired using two different wiring schemes. Finally, a flip may occur because not all cables have the same pair layout.

The relatively open design of the wire containment cap 104 shown in FIGS. 3-6 is due in large part to the spine 110 and support rib 114 being relatively thin. This open space allows a technician to more freely move wire pairs and individual wires within the wire containment cap 104 to make any required flips or bends. To complete the installation, the technician need only place wire pairs on the appropriate sides of the pair separators 112, secure individual wire pairs in the upper and lower wire retainers 116, 118, and attach the wire containment cap 104 to the front portion 102.

Figure 8:
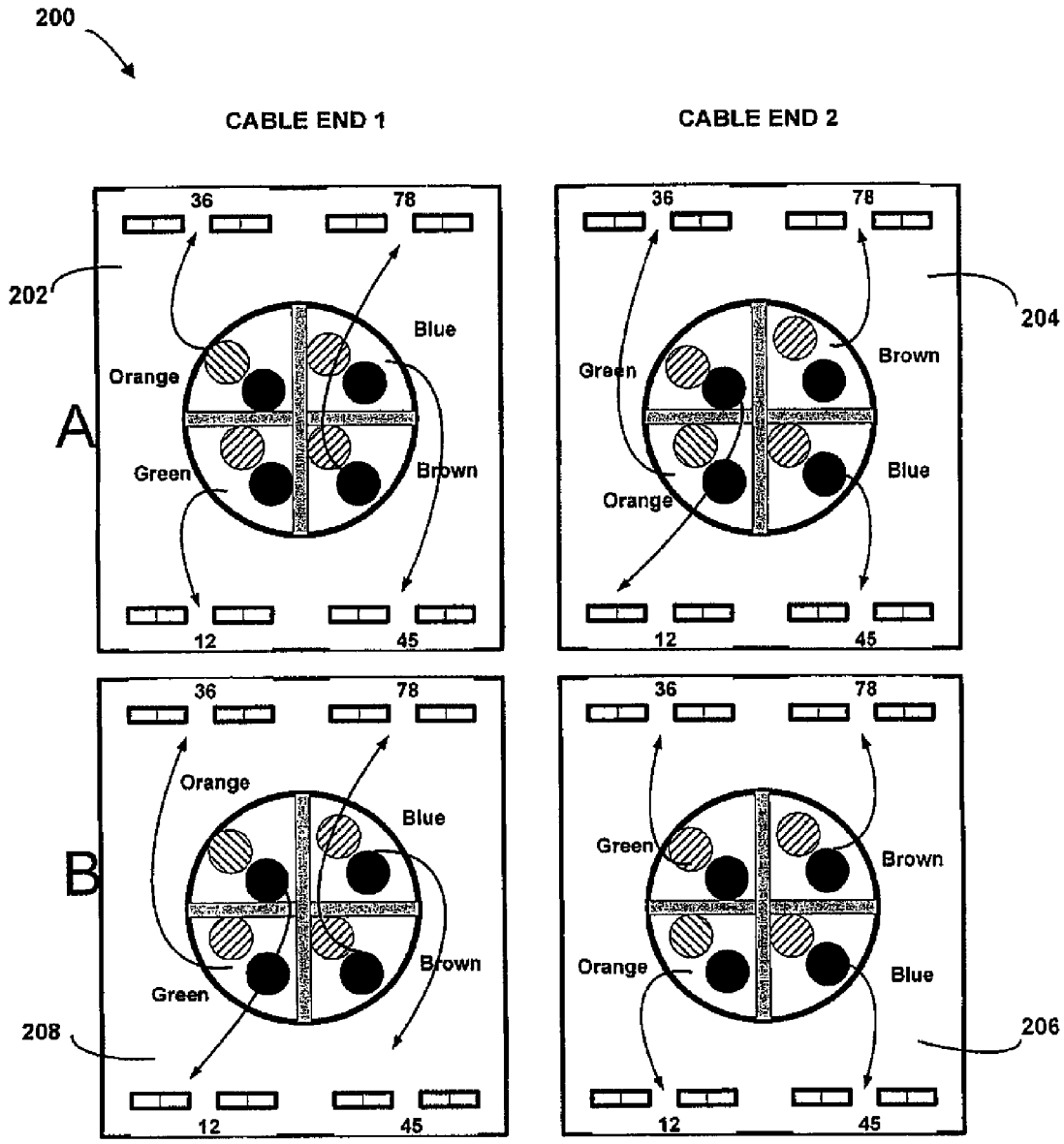
FIG. 8 is a conceptual diagram illustrating a wire pair alignment of opposite ends of a typical twisted pair cable with one example of an IDC terminal layout.

FIG. 8 is a conceptual diagram 200 illustrating the wire pair alignment of opposite ends of a typical twisted pair cable. The example shown is an IDC terminal layout designed to match a typical twisted pair cable when that cable is wired with the more commonly used 568-B wiring scheme. In diagram 202 and diagram 204, the wire pairs are aligned according to the 568-A wiring scheme. Under 568-A, the green wire pair of the twisted pair cable should be terminated to IDC terminal (1,2), the orange wire pair should be terminated to IDC terminal (3,6), the blue wire pair should be terminated to IDC terminal (4,5), and the brown wire pair should be terminated to IDC terminal (7,8). Diagram 202 illustrates the 568-A alignment of the wire pairs on one end of the twisted pair cable where the blue wire pair and the brown wire pair must be flipped in order to terminate those wire pairs to the appropriate IDC terminals. Diagram 204 illustrates the 568-A alignment of the wire pairs on the other end of the twisted pair cable shown in diagram 202. The wire layout in diagram 204 is a mirror image of the wire pair layout in diagram 202 and therefore different pairs are flipped. Diagram 204 shows the green wire pair and orange wire pair being flipped in order to terminate those wire pairs to the appropriate IDC terminal.

Diagram 206 and diagram 208 illustrate wire pairs aligned according to the more commonly used 568-B wiring scheme. Under 568-B, the alignment of the blue wire pair and the brown wire pair should not change from 568-A but the orange wire pair should now be terminated to IDC terminal (1,2) and the green pair should now be terminated to IDC terminal (3,6). Diagram 206 illustrates the 568-B alignment of the wire pairs on one end of the twisted pair cable where the wire pairs are matched to the IDC terminals and no wire pair flipping is necessary. Diagram 208 illustrates the 568-B alignment of the wire pairs on the other end of the twisted pair cable shown in diagram 206. The wire layout in diagram 208 is a mirror image of the wire pair layout in diagram 206 and therefore wire pairs are flipped. Diagram 208 shows the green wire pair being flipped with the orange wire pair and the blue wire pair being flipped with the brown wire pair in order to terminate those wire pairs to the appropriate IDC terminals.

Referring back to FIGS. 3-7, the pair separators 112 are employed to minimize the interaction of wire pairs when they need to be flipped as described above. The separators 112 help to ensure that the wire pairs will only cross each other top to bottom or side to side, but not a combination of both.

The upper and lower wire retainers 116, 118 are positioned to present the terminated wires to the front portion 102, preferably in a perpendicular orientation to IDC terminals that may be included as part of the front portion 102. In the illustrated embodiment, each wire retainers 116, 118 includes an inner portion and an outer portion (wire restraining features), with an intermediate portion through which the IDC terminals may make electrical contact with the wire by piercing insulation on the wire to make a metallic contact. The inner and outer portions in essence serve as bridge supports on either end of the wire to allow the wire insulation to be pierced when the wire containment cap is pressed into the front portion 102. The wire retainers 116, 118 are preferably spaced at regular intervals to allow for consistent pair-to-pair separation. When utilized in combination with the spine 110, pair separators 112, and support rib 114, improved electrical performance may be realized.

In typical operation, an installer may place a cable having an outer jacket diameter up to 0.310" into the rear of the wire containment cap 104 and separately route each twisted wire pair (blue, green, orange, and brown) as appropriate. As a result, the wire termination process is simplified and electrical performance is improved over typical jacks. The outer jacket diameter may vary from one application to the next, depending on the particular standards in place, for example. Typical maximums are 0.250" for Unshielded Twisted Pair (UTP) and 0.310" for Shielded Twisted Pair (STP).

Wire containment cap 104 shown in FIGS. 3-7 was generally designed around an IDC terminal layout substantially similar to the IDC terminal layout in FIG. 8. However, the techniques for wire pair separation utilized by wire containment cap 104 can be utilized generally to separate wire pairs in communication jacks with a variety of IDC terminal layout arrangements.

Figure 9:
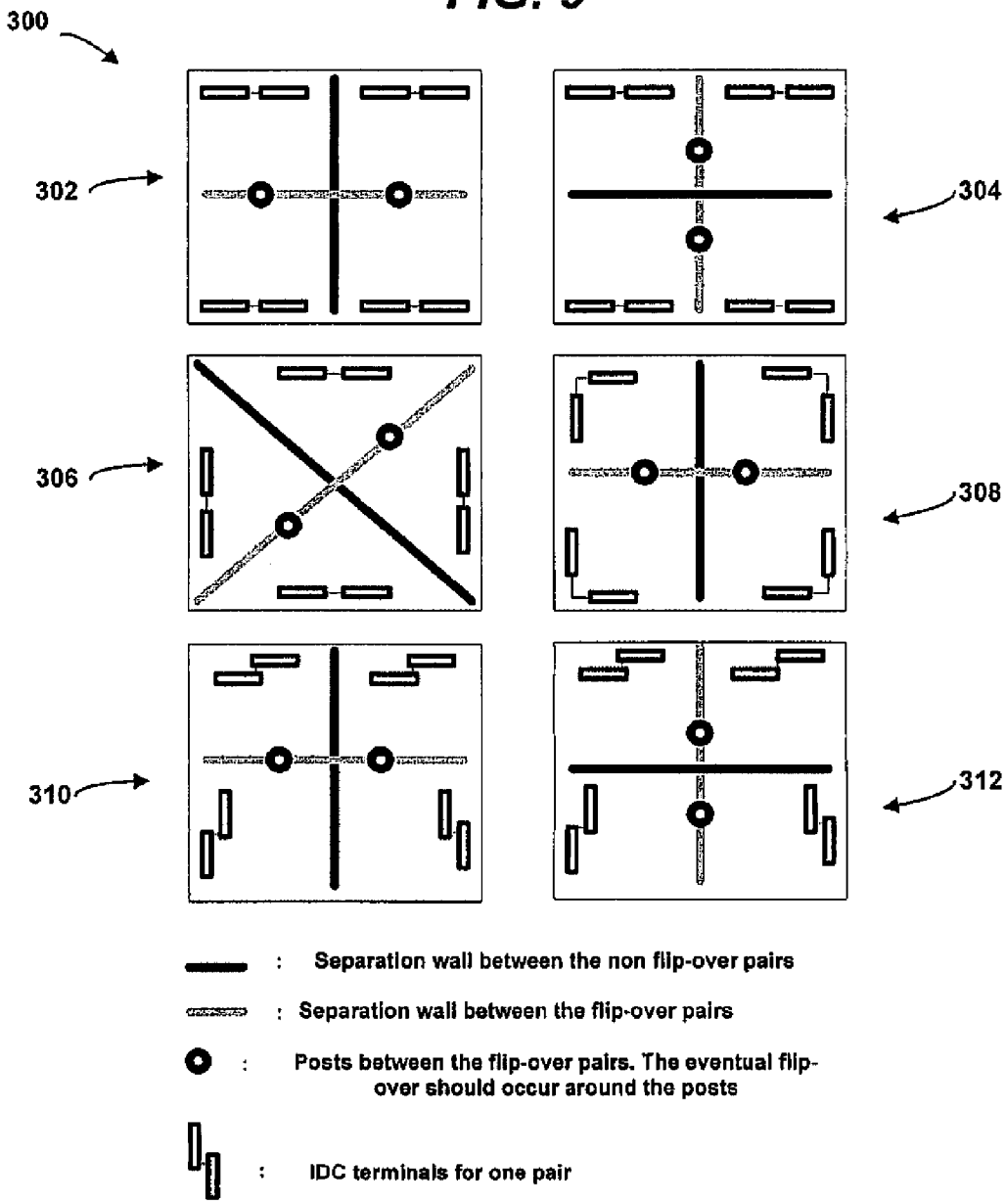
FIG. 9 illustrates diagrams 300 of six alternate IDC terminal layout arrangements along with the corresponding wire containment cap design for each of the arrangements. The diagrams 302, 304, 306, 308, 310, and 312 merely provide examples of different terminal layouts for IDCs 1-8 and different wire containment cap designs, but these diagrams do not comprise all of the possible design options available.

FIG. 9 illustrates diagrams 300 of six alternate IDC terminal layout arrangements along with the corresponding wire containment cap design for each of those arrangements. The diagrams 302, 304, 306, 308, 310, and 312 merely provide examples of different IDC terminal layouts and wire containment cap designs, but these diagrams do not comprise all of the possible design options available.

Figure 10:
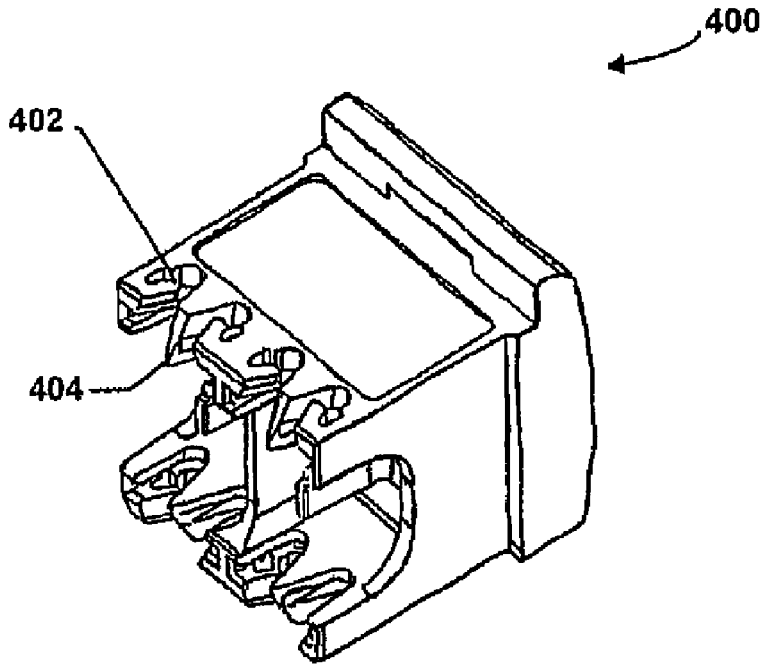
FIG. 10 is an upper right perspective view of a wire containment cap in accordance with an embodiment of the present invention.
Figure 11:
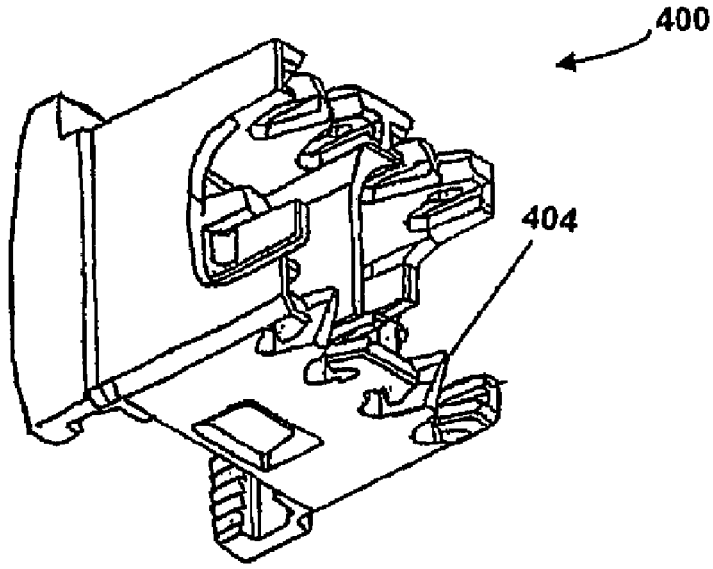
FIG. 11 is a lower left perspective view of a wire containment cap in accordance with an embodiment of the present invention.

FIGS. 10 and 11 illustrate an alternative wire containment cap 400. In this alternative embodiment, the wire containment cap 400 includes a plurality of wire retainers 402 that each flex to allow a wide range of wire sizes to be inserted and held in place after insertion. A small barb on each of the wire retainers 402 retains the wires so that they may be clipped to remain in position until installation. This allows the same connector assembly to be used for multiple wire sizes, thereby improving ease of installation for the technician. The wire containment cap 400 also includes a plurality of sloped pair splitters 404 that assist in maintaining a constant number of twists on the cable end of a wire pair. Each sloped pair splitter 404 terminates in a relatively sharp edge between neighboring wire retainers 402. This sharp edge can cut through insulation material holding bonded pairs together, allowing the wires to be placed into the wire retainers 402 without untwisting and pulling the wires apart by hand.

While certain features and embodiments of the present invention have been described in detail herein, it is to be understood that the invention encompasses all modifications and enhancements within the scope and spirit of the following claims.

We claim:

1. A wire containment cap comprising:

a first side, the first side including a plurality of retainers, each retainer for retaining a different wire; a second side, the second side being opposite the first side;

first and second sidewalls extending between the first side and the second side;

a support rib extending from the first sidewall proximate to a top of the wire containment cap to the second sidewall proximate to a bottom of the wire containment cap; and a spine intersecting the support rib and extending from the first sidewall proximate to the bottom of the wire containment cap to the second sidewall proximate to the top of the wire containment cap, the spine recessed in the wire cap such that a first side of the spine and a second side of the spine are recessed from the first and second sides of the wire cap, respectively, the spine including two pair separators for separating a pair of wires, the pair separators extending from the spine towards the first side of the wire cap, the support rib further comprising a first and a second side wherein the first side of the support rib protrudes substantially further towards the first side of the wire cap than does the first side of the spine.

2. The wire cap of claim 1 further comprising a plurality of sloped pair splitters, each of the sloped pair splitters located between two of the retainers and including a sharp point for cutting through insulation material on a pair of bonded wires.

3. The wire cap of claim 2 wherein each retainer comprises a barb for retaining the wire.

4. The wire cap of claim 2 wherein the pair separators extend generally perpendicularly from the support rib.

5. The wire cap of claim 2 wherein the plurality of retainers comprise upper pairs of retainers at a top of the wire cap and lower pairs of retainers at a bottom of the wire cap, each upper pair of retainers and each lower pair of retainers having a common wall that forms one side of the upper pair of retainers and the lower pair of retainers, respectively, the common wall forming one of the sloped pair splitters.

6. A communication jack assembly comprising:

a front portion, the front portion including a retention clip;

a wire containment cap, the wire containment cap including a retention recess for accepting the retention clip to secure the wire containment cap to the front portion;

the wire containment cap comprising:

a first side, the first side including a plurality of retainers, each retainer for retaining a different wire;

a second side, the second side being opposite the first side;

two sidewalls extending between the first side and the second side;

a support rib extending from the first sidewall proximate to a top of the wire containment cap to the second sidewall proximate to a bottom of the wire containment cap; and a spine intersecting the support rib and extending from the first sidewall proximate to the bottom of the wire containment cap to the second sidewall proximate to the top of the wire containment cap, the spine recessed in the wire cap such that a first side of the spine and a second side of the spine are recessed from the first and second sides of the wire cap, respectively, the spine including two pair separators for separating a pair of wires, the pair separators extending from the spine towards the first side of the wire cap, the support rib further comprising a first and a second side wherein the first side of the support rib protrudes substantially further towards the first side of the wire cap than does the first side of the spine.

7. The assembly of claim 6 further comprising a plurality of sloped pair splitters, each of the sloped pair splitters located between two of the retainers and including a sharp point for cutting through insulation material on a pair of bonded wires, each pair separator substantially thicker than the support rib.

8. The assembly of claim 7 wherein each retainer comprises a barb for retaining the wire.

9. The assembly of claim 7 wherein the pair separators extend generally perpendicular from the support rib.

10. The assembly of claim 7 wherein the plurality of retainers comprise upper pairs of retainers at a top of the wire cap and lower pairs of retainers at a bottom of the wire cap, each upper pair of retainers and each lower pair of retainers having a common wall that forms one side of the upper pair of retainers and the lower pair of retainers, respectively, the common wall forming one of the sloped pair splitters.

* * * * *